US005979131A

United States Patent [19]

Remmele et al.

[11] Patent Number: 5,979,131

[45] Date of Patent: Nov. 9, 1999

[54] EXTERIOR INSULATION AND FINISH SYSTEM

[75] Inventors: Thomas Remmele, Powder Springs; Jeremy Noce, Atlanta, both of Ga.

[73] Assignee: Sto Corp., Atlanta, Ga.

[21] Appl. No.: 09/060,309

[22] Filed: Apr. 15, 1998

[51] Int. Cl.[6] ..... E04C 2/288

[52] U.S. Cl. ..... 52/309.9; 52/309.12; 52/169.5; 52/169.11; 52/408; 52/446; 52/454; 52/302.3; 52/169.14; 442/22; 442/45; 428/317.7; 156/90; 156/306.6

[58] Field of Search ..... 52/169.11, 169.14, 52/309.8, 309.9, 309.12, 309.17, 408, 409, 411, 446, 449, 454, 741.4, 741.41, 169.5, 302.3, 794.1; 428/317.7; 442/22, 45; 156/90, 306.6

[56] References Cited

U.S. PATENT DOCUMENTS

| | | | |
|---|---|---|---|
| 1,660,916 | 2/1928 | Bullard . | |
| 2,109,719 | 3/1938 | Brusse . | |
| 2,358,550 | 9/1944 | Williams . | |
| 3,274,048 | 9/1966 | Armour et al. . | |
| 3,387,420 | 6/1968 | Long . | |
| 3,389,518 | 6/1968 | Horbach | 52/309.17 X |
| 3,492,196 | 1/1970 | Moore | 52/309.12 X |
| 3,697,618 | 10/1972 | Grunewalder . | |
| 3,880,956 | 4/1975 | Skoultchi . | |
| 3,957,561 | 5/1976 | Skoultchi . | |
| 4,054,480 | 10/1977 | Skoultchi et al. . | |
| 4,056,670 | 11/1977 | Skoultchi . | |
| 4,349,398 | 9/1982 | Kearns et al. . | |
| 4,522,004 | 6/1985 | Evans et al. | 52/454 X |
| 4,525,970 | 7/1985 | Evans | 52/454 |
| 4,578,915 | 4/1986 | Schneller | 52/446 X |
| 4,653,243 | 3/1987 | Burkett | 52/309.8 X |
| 4,730,953 | 3/1988 | Tarko . | |
| 4,735,027 | 4/1988 | Evans et al. | 52/446 X |
| 4,855,172 | 8/1989 | Chiu . | |
| 4,882,888 | 11/1989 | Moore | 52/408 X |
| 5,021,525 | 6/1991 | Montague et al. . | |
| 5,056,281 | 10/1991 | McCarthy . | |
| 5,224,316 | 7/1993 | Fredericks et al. | 52/454 X |
| 5,410,852 | 5/1995 | Edgar et al. | 52/408 |
| 5,511,346 | 4/1996 | Konworthy . | |
| 5,535,556 | 7/1996 | Hughes, Jr. . | |
| 5,615,525 | 4/1997 | Kenworthy . | |
| 5,704,172 | 1/1998 | Gougeon et al. . | |
| 5,732,570 | 3/1998 | Maieha | 52/741.1 |
| 5,842,315 | 12/1998 | Lin . | |

FOREIGN PATENT DOCUMENTS

| | | | |
|---|---|---|---|
| 9644 | 7/1886 | United Kingdom | 52/454 |

*Primary Examiner*—Robert Canfield

*Attorney, Agent, or Firm*—Jacobson, Price, Holman & Stern, PLLC

[57] ABSTRACT

An exterior insulation and finish system is produced for exterior construction having a primary weather proofing layer formed by a finish coat and a secondary seal is provided intermediate of the various layers of exterior insulation between a sheathing substrate and insulation board. The secondary seal layer also serves to adhesively secure the insulation board to the sheathing substrate.

13 Claims, 2 Drawing Sheets

EXTERIOR INSULATION AND FINISH SYSTEM

FIELD OF THE INVENTION

The present invention relates to an exterior insulation and finish system having an intermediary layer serving as both an adhesive and a weather resistive barrier in exterior wall construction.

BACKGROUND OF THE INVENTION

Traditionally, in building construction, two weather resistive seals are normally provided. Usually, some exterior coating or layer provides protection against the elements. Additionally, an intermediary sealing layer is located between the studs and exterior facing. This intermediary or secondary seal has traditionally been provided by a layer of Kraft paper, tarred felt, fabric or TYVEK plastic sheeting material.

Construction of exterior insulation and facing material including a primary and secondary seal requires construction of each layer in a certain sequence with predetermined time intervals for construction of each layer. In addition, a cost is associated with each layer in terms of materials as well as labor for its installation.

SUMMARY OF THE INVENTION

Accordingly, it is an object of the present invention to eliminate the necessity for a layer of secondary seal material by providing the qualities of a secondary seal by a specialized adhesive which secures together an exterior sheathing substrate and expanded polystyrene (EPS) insulation board as part of an exterior insulation and finish system. The adhesive between the exterior sheathing substrate and EPS insulation board provides a secondary seal supplemental to the exterior finish coat.

By the present invention the cost of materials and labor in providing a separate secondary seal layer in the exterior construction of a building, is avoided. The advantages and safeguards provided by a secondary seal are maintained while avoiding the materials cost and labor costs for installation of an added secondary seal layer.

The objects of the present invention are achieved by securing a wood or gypsum sheathing substrate to the frame of a building under construction. To the sheathing substrate is applied a fast setting, water-based contact adhesive which is a secondary weather resistive barrier to protect the wood or gypsum sheathing substrate from damage due to excess moisture intrusion through the exterior insulation and finish system of the present invention or though other components of construction. An example of one possible adhesive which meets the requirements of the present invention is BOND-MASTER adhesive, manufactured by National Starch & Chemical Company of Bridgewater, N.J. This adhesive has traditionally been used on interior construction used for only its adhesive properties. It is, accordingly, within the scope of the present invention to incorporate a layer into the exterior insulation and finish system which has the desired properties of both adhesion and sealing in a single layer, which replaces the traditional specified secondary seal material layer which was separately secured in place by labor intensive practices. The adhesive and seal layer is applied in a uniform, continuous coat to the sheathing substrate by a roll, brush or spray to achieve a minimum coverage rate of three to four wet mils. The layer is allowed to dry for a period of fifteen to thirty minutes or until the surface is dry to the touch.

Secured to the adhesive and seal layer of the present invention is a nominal 1.0 lb./cu. ft. EPS insulation board or a rigid, extruded polystyrene insulation board. The board has a minimum thickness of 1½ inches and includes drainage grooves facing the adhesive and seal layer.

The insulation board is dry cut before application to the adhesive and seal layer. After the adhesive and seal layer is dried, the insulation board is carefully positioned onto the sheathing substrate and then pressed into place. Hand roller pressure is applied over the entire insulation board surface to ensure a complete bond. Any open joints in the insulation board layer are filled with slivers of insulation or spray insulation foam. After the insulation boards are firmly attached to the sheathing substrate, the surface of the insulation board is rasped to achieve a smooth, even surface and to remove any ultraviolet ray damage.

On top of the opposite surface of the insulation board is applied a base coat made up of one of the following. (1) A non-cementitious, fiber reinforced acrylic base coat, (2) a one-component polymer modified cementitious base coat with less than 33% Portland cement content by weight, (3) a one-component polymer modified cementitious high build base coat with less than 33% Portland cement content by weight, or (4) a fiber reinforced acrylic base coat mixed with Portland cement.

The base coat is applied to the exposed edges of the insulation board. A reinforcing mesh layer is then pulled tight around the insulation boards and embedded in the wet base coat. The mesh layer may be one of the following. (1) A nominal 4.8 ounce/square yard, symmetrical interlaced open-weave glass fiber fabric made with a minimum 25% by weight alkaline resistant coating, (2) a nominal 11.2 ounce/square yard, high impact interwoven open-weave glass fiber fabric with alkaline resistant coating, (3) a nominal 15 ounce/square yard, ultra-high impact, double strand, interwoven, open-weave glass fiber fabric with alkaline resistant coating, (4) a nominal 4.5 ounce/square yard, flexible, symmetrical, interlaced glass fiber fabric with alkaline resistant coating, or (5) a nominal 6.25 ounce/square yard, precreased, heavy-duty open-weave woven glass fiber fabric with alkaline resistant coating.

The mesh must be fully embedded in the base coat so that no mesh color shows through the base coat when it is dry. If necessary, additional base coats may be reskimmed across the mesh layer, if mesh color is visible.

After the base coat/mesh layer has thoroughly dried, a finish coat of acrylic based or silicone enhanced textured wall coating is applied. The finish coat is applied by spraying or troweling. Alternatively, acrylic based or silicone enhanced primer may be applied to the base coat before the finish coat is applied over the primed base coat.

By the present invention, an exterior insulation and finish system is produced for exterior construction having a primary weather proofing layer formed by a finish coat and a secondary seal is provided intermediate of the various layers of exterior insulation between a sheathing substrate and insulation board. The secondary seal layer also serves to adhesively secure the insulation board to the sheathing substrate.

As a result of the present invention, a savings in material and labor costs is provided by a system which provides primary and secondary weather proof sealing to exterior building construction.

It is therefore another object of the present invention to provide an exterior insulation and finish system having a plurality of layers including a primary and secondary seal.

It is yet another object of the present invention to provide an exterior insulation and finish system having a plurality of layers including a sheathing substrate, an insulation board, a base coat, a mesh layer and a finish coat.

It is still yet another object of the present invention to provide an exterior insulation and finish system having a plurality of layers including an insulation board adhesively secured to a sheathing substrate to provide a secondary seal to the system.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
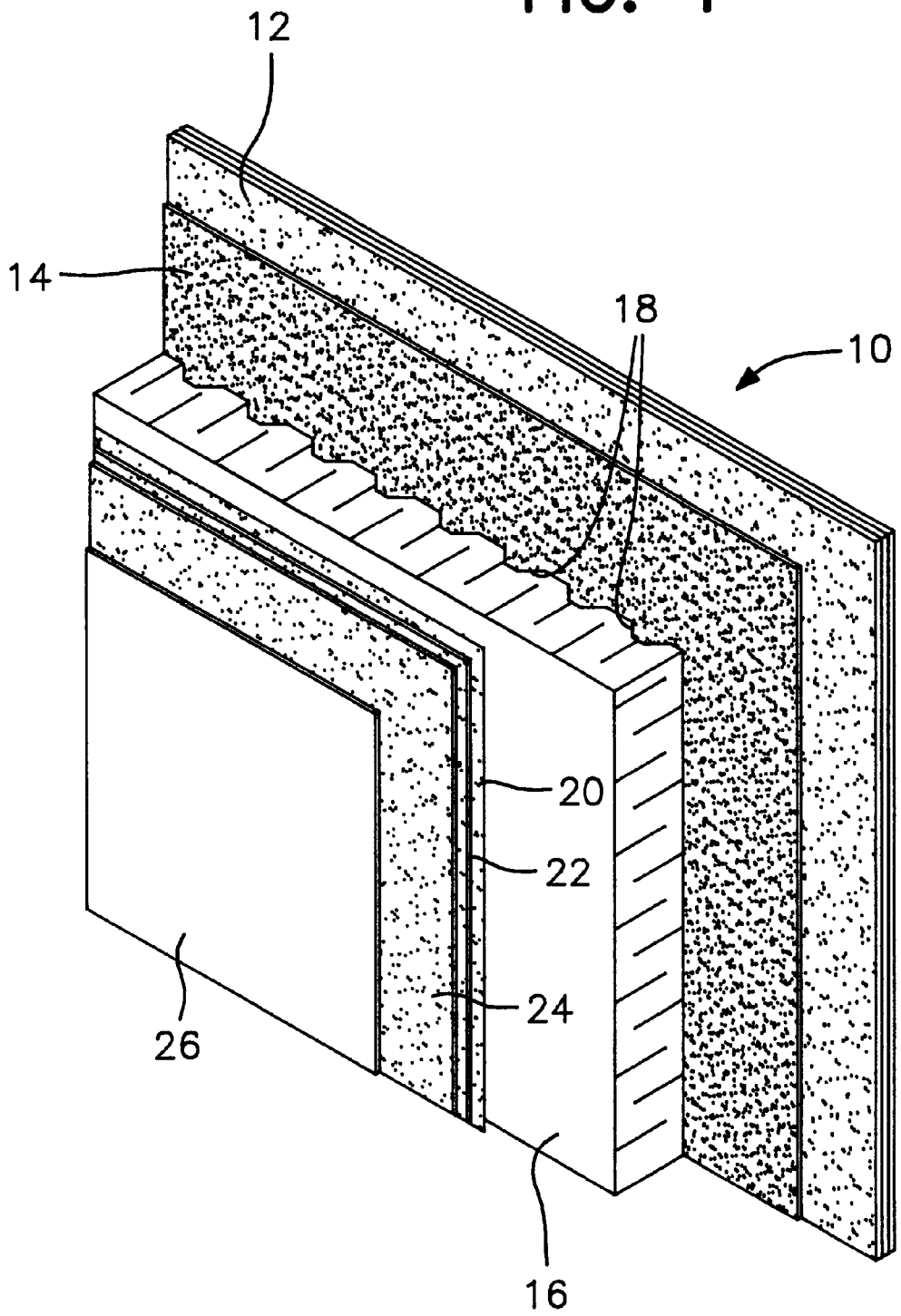
FIG. 1 is a schematic representation of the various layers forming the exterior insulation and finish system of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1 in particular, an exterior insulation and finish system embodying the teachings of the subject invention is generally designated as 10. With reference to its orientation in FIG. 1, the exterior insulation and finish system 10 comprises a first layer 12 of sheathing substrate which is normally applied to the exterior of a building under construction. The sheathing 12 may be gypsum sheathing, exposure I oriented strand board, exterior or exposure I plywood or cementitious sheathings.

Applied to the first layer 12, with a ½ inch nap paint roller, is an adhesive and seal layer 14. The adhesive is 100% water based and fast drying so as to decrease installation time. In addition, once dried, the layer is flexible so as to bridge normal movement in the first layer 12. The adhesive and seal layer 14 forms a weather proof seal for the first layer 12.

After drying, an insulation board 16 having a plurality of grooves 18 is adhered to the first layer 12 by the adhesive and seal layer 14. Hand roller pressure is applied over the entire insulation board surface to ensure a complete bond.

An initial base coat 20 is applied to the surface of the insulation board opposite to the surface which is secured to the substrate layer 12 by the adhesive and seal layer 14. The base coat is applied over the insulation board with spray equipment or a trowel to a uniform thickness of approximately 1/16 of an inch.

A mesh layer 22 is immediately embedded in the wet base coat 20 by troweling from the center of the mesh to the edge of the mesh. Seams of the mesh are overlapped to form a uniform surface layer. If the mesh is not completely embedded in the base coat 20, an additional base coat 24 is applied over the surface of the mesh material 22.

Finally, a finish coat 26 of an acrylic base or silicone enhanced textured wall coating is applied on the base coat 24. The finish coat 26 is applied by spraying or troweling, depending on the specific finish desired.

Figure 2:
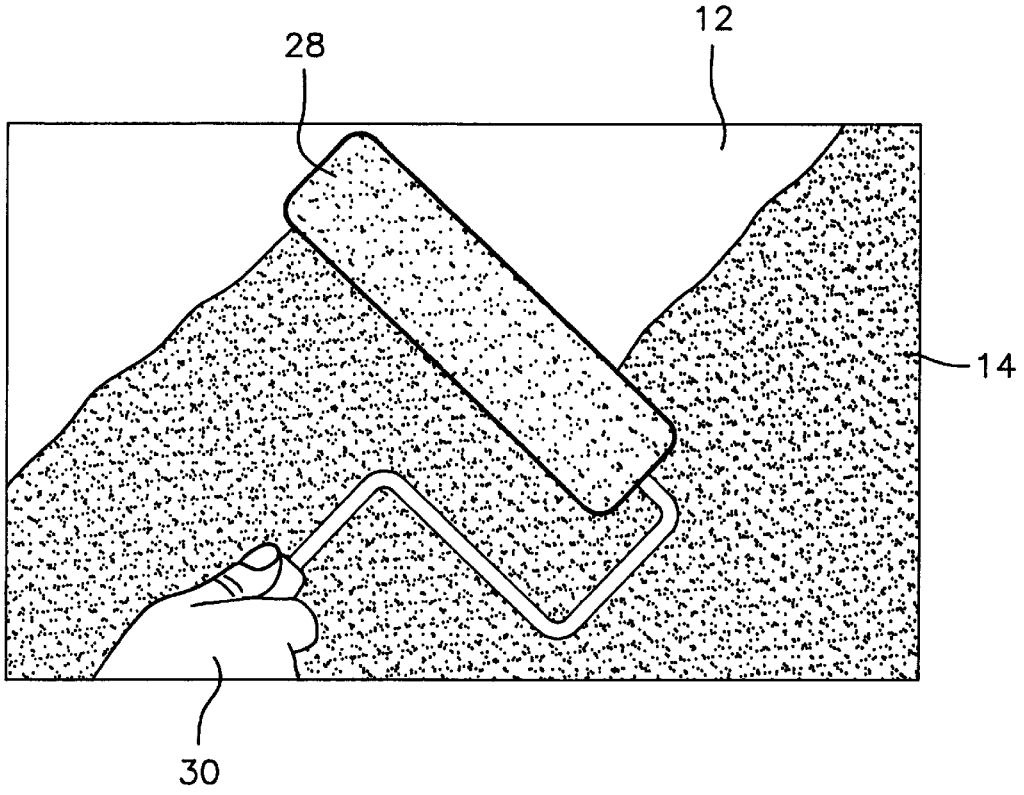
FIG. 2 illustrates application of an adhesive sealer onto a layer of sheathing substrate formed by wood.

In FIG. 2, application of an adhesive and seal layer 14 is shown being applied onto a substrate layer 12 which, in this example, is exterior plywood. The adhesive and seal layer 14 is applied by a roller 28 held by the hand 30 of an individual.

Figure 3:
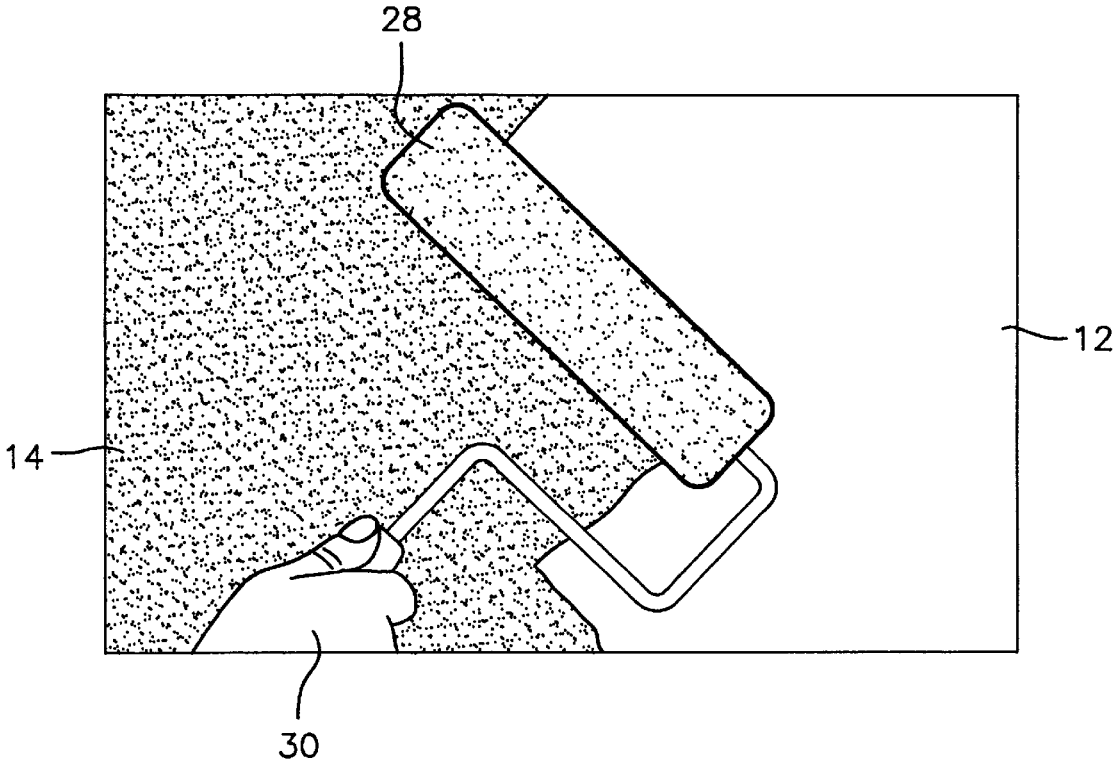
FIG. 3 illustrates application of an adhesive sealer onto a layer of sheathing substrate formed by gypsum.

In the example shown in FIG. 3, layer 14 is being applied to a substrate layer 12 which, in this example, is gypsum. Again, the roller 28 held by the hand 30 of an operator provides the required 3 to 4 wet mils coverage. However, the amount of coverage provided by the adhesive and seal layer will vary depending upon the substrate's smoothness and porosity.

By the exterior insulation and finish system of the present invention, a dual purpose layer interposed between a sheathing substrate and an insulation board provides adhesion between the sheathing substrate and insulation board and a secondary weather resistive barrier to protect the sheathing substrate from damage due to incidental moisture intrusion behind the system.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. An exterior insulation and finish system for a building, said system comprising:

a sheathing substrate layer for attachment to a frame of a building, an insulation board layer, a single adhesive and sealing layer adhesively securing said insulation board layer to said sheathing substrate layer for providing a secondary weather resistive barrier to protect the sheathing substrate layer from damage due to incidental moisture intrusion, a base coat applied to said insulation board layer, a mesh layer embedded in said base coat, and a finish layer applied to said base coat, said insulation board layer have two opposite surfaces with one of said two surfaces being grooved and said one, grooved surface being adhesively secured to said substrate layer by said single adhesive and sealing layer.

2. An exterior insulation and finish system for a building as claimed in claim 1, wherein said sheathing substrate layer is exterior plywood.

3. An exterior insulation and finish system for a building as claimed in claim 1, wherein said sheathing substrate layer is gypsum.

4. An exterior insulation and finish system for a building as claimed in claim 1, wherein said sealing layer is 3 to 4 mils thick in a wet condition.

5. An exterior insulation and finish system for a building as claimed in claim 1, wherein said insulation board is expanded polystyrene.

6. An exterior insulation and finish system for a building as claimed in claim 1, wherein said insulation board is extruded polystyrene.

7. An exterior insulation and finish system for a building, said system comprising:

a primary weather resistive barrier, and a secondary weather resistive barrier including a single adhesive and sealing layer adhesively securing a grooved surface of an insulation layer to a substrate layer, said primary weather resistive barrier being located on another surface of said insulation layer.

8. An exterior insulation and finish system for a building as claimed in claim 7, wherein said substrate layer is sheathing applied to a frame of a building.

9. An exterior insulation and finish system for a building as claimed in claim 8, wherein said sheathing is oriented strand board plywood.

10. An exterior insulation and finish system for a building as claimed in claim 8, wherein said sheathing is gypsum.

11. An exterior insulation and finish system for a building as claimed in claim 7, wherein said insulation layer is expanded polystyrene.

12. An exterior insulation and finish system for a building as claimed in claim 7, wherein said insulation layer is extruded polystyrene.

13. An exterior insulation and finish system for a building as claimed in claim 8, wherein said sheathing is cementitious sheathing.

* * * * *